US010947624B2

(12) United States Patent
Toyoshima et al.

(10) Patent No.: US 10,947,624 B2
(45) Date of Patent: Mar. 16, 2021

(54) FUEL DISTRIBUTION PIPE

(71) Applicant: SANOH INDUSTRIAL CO., LTD., Tokyo (JP)

(72) Inventors: Hideki Toyoshima, Koga (JP); Kento Kanaya, Koga (JP)

(73) Assignee: SANOH INDUSTRIAL CO., LTD., Tokyo (JP)

( * ) Notice: Subject to any disclaimer, the term of this patent is extended or adjusted under 35 U.S.C. 154(b) by 194 days.

(21) Appl. No.: 15/777,595

(22) PCT Filed: Jul. 14, 2016

(86) PCT No.: PCT/JP2016/070892
§ 371 (c)(1),
(2) Date: May 18, 2018

(87) PCT Pub. No.: WO2017/085962
PCT Pub. Date: May 26, 2017

(65) Prior Publication Data
US 2020/0063702 A1 Feb. 27, 2020

(30) Foreign Application Priority Data
Nov. 18, 2015 (JP) ..... JP2015-225979

(51) Int. Cl.
*C23C 18/48* (2006.01)
*F02M 55/02* (2006.01)
(Continued)

(52) U.S. Cl.
CPC ..... *C23C 28/322* (2013.01); *C23C 18/32* (2013.01); *C23C 18/48* (2013.01); *C23C 28/32* (2013.01);
(Continued)

(58) Field of Classification Search
CPC ..... F02M 55/025; F02M 2200/05; F02M 2200/856; F02M 2200/9046;
(Continued)

(56) References Cited

U.S. PATENT DOCUMENTS 6,291,083 B1 * 9/2001 Wada ..... C23C 28/321 428/632
2001/0010216 A1 * 8/2001 Usui ..... F02M 55/005 123/456
(Continued)

FOREIGN PATENT DOCUMENTS

CN 102095031 A 6/2011
CN 104428447 A 3/2015
(Continued)

OTHER PUBLICATIONS

International Preliminary Report on Patentability for PCT App PCT/JP2016/070892 dated May 31, 2018, 9 pgs.
(Continued)

*Primary Examiner* — Mahmoud Gimie
(74) *Attorney, Agent, or Firm* — Procopio, Cory, Hargreaves & Savitch LLP

(57) ABSTRACT

Provided is a fuel distribution pipe connected to a fuel pipe and distributes and supplies fuel to a plurality of fuel injection devices, comprising: a tubular base material forming a body of the fuel distribution pipe; and a plating layer formed on a surface of the base material, wherein the base material includes a sealing surface formed on an inner peripheral surface thereof and comes into press-contact with the fuel pipe, and wherein a thickness of the plating layer on the sealing surface is thinner than that of the plating layer on an outer peripheral surface of the fuel distribution pipe.

11 Claims, 13 Drawing Sheets

(51) Int. Cl.
*C23C 28/00* (2006.01)
*C23C 18/32* (2006.01)
*C23C 30/00* (2006.01)

(52) U.S. Cl.
CPC ..... *C23C 28/3225* (2013.01); *C23C 30/00* (2013.01); *F02M 55/025* (2013.01); *F02M 2200/05* (2013.01); *F02M 2200/856* (2013.01); *F02M 2200/9046* (2013.01); *F02M 2200/9053* (2013.01)

(58) Field of Classification Search
CPC .... F02M 2200/9053; F02M 2200/9038; C23C 18/32; C23C 18/48; C23C 30/00; C23C 28/322; C23C 28/3225; C23C 28/32
USPC ..... 123/468, 456
See application file for complete search history.

(56) References Cited

U.S. PATENT DOCUMENTS

2002/0005223 A1* 1/2002 Campagna ..... F16L 58/109 138/146
2003/0188715 A1* 10/2003 Endo ..... F02M 55/005 123/447
2005/0031894 A1* 2/2005 Klos ..... B32B 1/08 428/659
2005/0236060 A1* 10/2005 Matsubara ..... C25D 5/48 138/143
2011/0048380 A1* 3/2011 Isogai ..... B23P 15/00 123/468
2012/0118746 A1* 5/2012 Isogai ..... C23C 18/1608 205/50
2016/0230725 A1* 8/2016 Katsumata ..... F02M 55/02

FOREIGN PATENT DOCUMENTS

EP 1350946 A2 10/2003
GB 2360075 A 9/2001
JP 2001-020826 A 1/2001
JP 2001-280218 A 10/2001
JP 2003-021018 A 1/2003
JP 2004-003455 A 1/2004
JP 2006-194233 A 7/2006
JP 2007-056816 A 3/2007
JP 2007-170581 A 7/2007
JP 2010-242712 A 10/2010
JP 2011-226353 A 11/2011
JP 2012-026357 A 2/2012
JP 2012-102386 A 5/2012
JP 2015-121107 A 7/2015

OTHER PUBLICATIONS

International Search Report for related PCT Application No. PCT/JP2016/070892, dated Sep. 20, 2016; 3 pages.
Office Action for related CN App No. 201680066690.8 dated Sep. 29, 2019, 7 pgs.

* cited by examiner (a)

(b)

(a)

(b)

FUEL DISTRIBUTION PIPE

CROSS-REFERENCE TO RELATED APPLICATIONS

This application is a U.S. National Stage entry of PCT Application No: PCT/JP2016/070892 filed Jul. 14, 2016, which claims priority to Japanese Patent Application No. 2015-225979, filed Nov. 18, 2015, the contents of which are incorporated herein by reference.

TECHNICAL FIELD

The present invention relates to a fuel distribution pipe which distributes and supplies fuel to a plurality of fuel injection devices.

BACKGROUND ART

In a direct injection engine or the like, high-pressure fuel compressed by a high-pressure pump is distributed and supplied to a plurality of fuel injection devices using a fuel distribution supply device. In the fuel distribution supply device, a fuel pipe which is connected to the high-pressure pump is separably connected to a fuel distribution pipe which distributes and supplies fuel to the plurality of fuel injection devices. Then, a front end portion of the fuel pipe at the side of the fuel distribution pipe is provided with a connection head portion and a front end portion of the fuel distribution pipe at the side of the fuel pipe is provided with a sealing surface which comes into press-contact with the connection head portion.

Generally, the fuel distribution pipes are formed of stainless steel such as SUS, but carbon steel (iron) can be considered as a material in order to reduce cost and improve strength. However, when carbon steel is used as a material, there is a need to cover the surface with a plating as a corrosion resistance measure. Specifically, an electroless nickel plating is formed on the surface of the fuel distribution pipe and a zinc plating or zinc nickel plating is formed thereon. The electroless nickel plating is a plating for securing corrosion resistance of an inner surface against fuel such as alcohol fuel and degraded fuel and is formed on the entire surface of the fuel distribution pipe. The zinc plating or zinc nickel plating is a plating mainly used to secure corrosion resistance against salt damage from the external environment and is formed on the outer peripheral surface, both end surfaces, and the sealing surface of the fuel distribution pipe.

CITATION LIST

Patent Literature

Patent Literature 1: Japanese Unexamined Patent Publication No. 2004-003455

SUMMARY OF INVENTION

Technical Problem

Meanwhile, in the fuel distribution supply device, the fuel pipe is separated from the fuel distribution pipe in some cases at the time of inspecting a vehicle. In such a case, the fuel pipe is connected to the fuel distribution pipe again after the inspection, but at that time, there is a possibility that the plating formed on the sealing surface of the fuel distribution pipe may crack and peel off. If peeled plating pieces enter the fuel injection device or the engine so that contaminations occur, there is a possibility that engine malfunction may occur.

In this regard, Patent Literature 1 describes a high-pressure fuel supply device that does not form a plating on the sealing surface. However, in the high-pressure fuel supply device described in Patent Literature 1, since no plating is formed on the sealing surface, corrosion resistance of the sealing surface against alcohol fuel and degraded fuel cannot be secured.

Here, an object of an aspect of the present invention is to provide a fuel distribution pipe capable of suppressing contamination due to a plating piece while securing corrosion resistance of a sealing surface.

Solution to Problem

A fuel distribution pipe according to an aspect of the present invention is a fuel distribution pipe connected to a fuel pipe and distributes and supplies fuel to a plurality of fuel injection devices, including: a tubular base material forming a body of the fuel distribution pipe; and a plating layer formed on a surface of the base material, wherein the base material includes a sealing surface formed on an inner peripheral surface thereof and comes into press-contact with the fuel pipe, and wherein a thickness of the plating layer on the sealing surface is thinner than that of the plating layer on an outer peripheral surface of the fuel distribution pipe.

In the fuel distribution pipe according to an aspect of the present invention, since the plating layer is formed on the surface of the base material, corrosion resistance of the fuel distribution pipe can be secured. Further, since the thickness of the plating layer on the sealing surface is thinner than the thickness of the plating layer on the outer peripheral surface, it is possible to suppress the cracking of the plating layer due to the reconnection of the fuel pipe. Accordingly, it is possible to suppress contamination caused by the plating piece.

In the fuel distribution pipe, the plating layer may be composed a plurality of layers and the number of layers of the plating layer on the sealing surface may be smaller than the number of layers of the plating layer on the outer peripheral surface. In the fuel distribution pipe, since the thickness of the plating layer on the sealing surface is thinner than the thickness of the plating layer on the outer peripheral surface, it is possible to suppress contamination caused by the plating piece.

In the fuel distribution pipe, the plating layer may be composed a plurality of layers and a thickness of a specific layer which is any one layer of the plating layers on the sealing surface may be thinner than that of the specific layer on the outer peripheral surface. In the fuel distribution pipe, since the thickness of the plating layer on the sealing surface is thinner than the thickness of the plating layer on the outer peripheral surface, it is possible to suppress contamination caused by the plating piece.

In this case, a thickness of the specific layer on the sealing surface may be larger than 0% and equal to or smaller than 80% of the thickness of the specific layer on the outer peripheral surface. In the fuel distribution pipe, since the thickness of the specific layer on the sealing surface is set to be larger than 0% and equal to or smaller than 80% of the thickness of the specific layer on the outer peripheral surface, it is possible to further suppress contamination caused by the plating piece.

In the fuel distribution pipe, the sealing surface may be formed in a tapered shape increasing in diameter toward an end surface. In the fuel distribution pipe, since the sealing surface is formed in a tapered shape, the adhesion with respect to the connection head portion of the fuel pipe is improved. In this case, a part inside a position where the connection head portion to be in a press-contact state also contacts the fuel even on the sealing surface. However, since the plating layer is formed on the sealing surface, the corrosion resistance at that portion can be secured.

In the fuel distribution pipe, the base material may be carbon steel. In the fuel distribution pipe, since the base material is carbon steel, it is possible to reduce cost compared to a case in which the base material is stainless steel.

In the fuel distribution pipe, the plating layer may be at least one of a nickel plating, a zinc plating, and a zinc alloy plating. In the fuel distribution pipe, since the plating layer is at least one of a nickel plating, a zinc plating, and a zinc alloy plating, corrosion resistance can be sufficiently secured. For example, in the case of the electroless nickel plating, it is possible to secure corrosion resistance against fuel such as alcohol fuel and degraded fuel in the fuel contact portion. Then, in the case of the zinc plating or zinc alloy plating, it is possible to secure corrosion resistance against salt damage from the external environment.

Meanwhile, the present inventors further carefully studied about the peeling of the plating of the sealing surface and found that the number and size of the plating pieces peeled from the sealing surface was small when the Vickers hardness of the base material was set to be equal to or higher than a predetermined hardness. From such knowledge, in the fuel distribution pipe, the Vickers hardness [Hv] of the sealing surface of the base material may be 230 or more. In the fuel distribution pipe, since the Vickers hardness of the sealing surface of the base material is 230 or more, deformation of the sealing surface in the fastening state is suppressed. Accordingly, the cracking of the plating layer on the sealing surface is suppressed and the number and size of the plating pieces peeled from the sealing surface can be made small.

The fuel distribution pipe may further include a connection portion provided with the sealing surface and connected to the fuel pipe; a pipe portion fixed to the fuel distribution pipe; and a plurality of cup portions fixed to the pipe portion and respectively attached to the plurality of fuel injection devices. In the fuel distribution pipe, since the connection portion and the plurality of cup portions are fixed to the pipe portion, the fuel sent from the fuel pipe can be appropriately distributed and supplied to the plurality of fuel injection devices.

Advantageous Effects of Invention

According to an aspect of the present invention, it is possible to suppress contamination caused by a plating piece while securing the corrosion resistance of a sealing surface.

DESCRIPTION OF EMBODIMENTS

Figure 1:
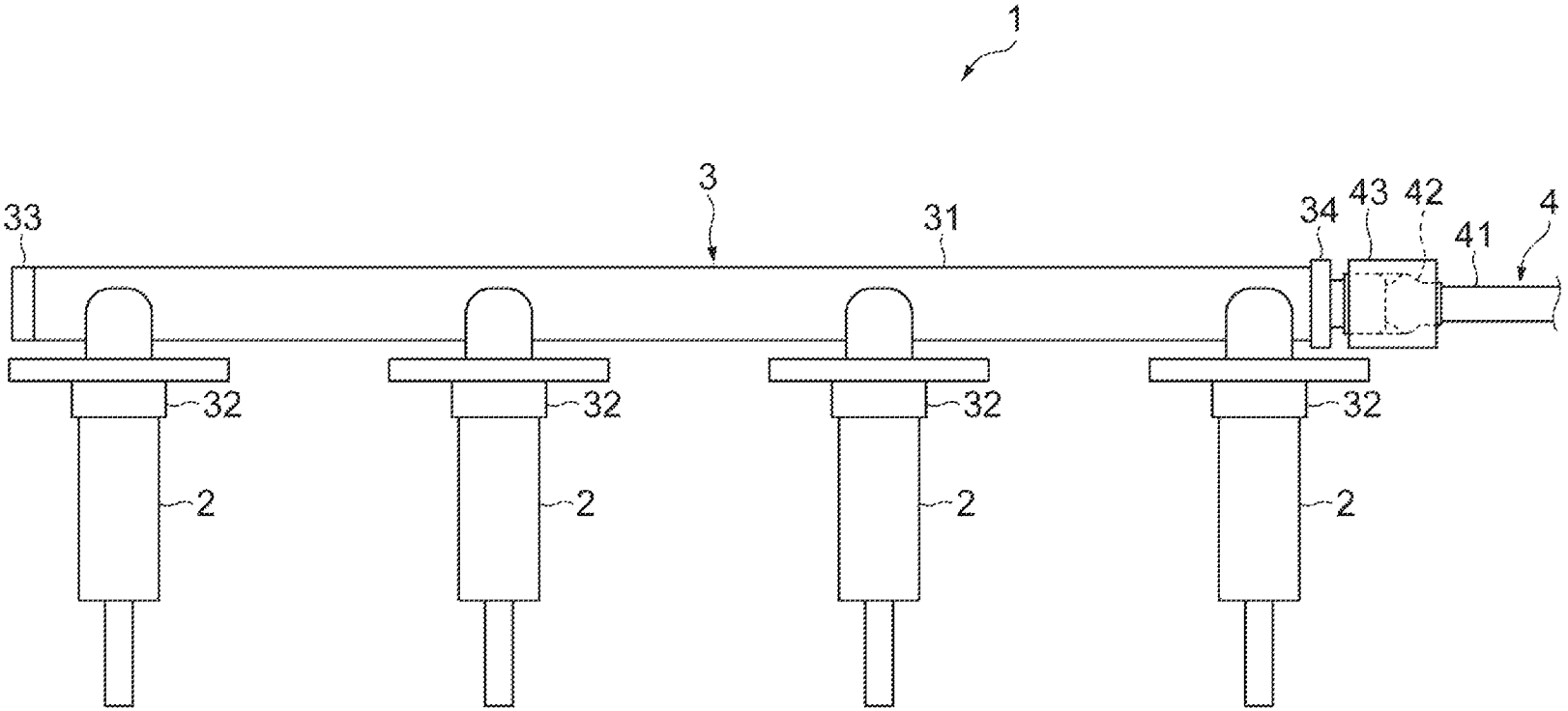
FIG. 1 is a plan view showing a part of a fuel distribution supply device.

Hereinafter, a fuel distribution pipe according to an embodiment will be described with reference to the drawings. In the drawings, the same or corresponding components will be denoted by the same reference numerals and a repetitive description thereof will be omitted.

FIG. 1 is a plan view showing a part of a fuel distribution supply device. As shown in FIG. 1, a fuel distribution supply device 1 is used to distribute and supply high-pressure fuel compressed by a high-pressure pump (not shown) to a fuel injection device 2 provided to correspond to each cylinder of an engine (not shown). The fuel distribution supply device 1 is also called a fuel delivery pipe, a common rail, or the like.

The fuel distribution supply device 1 includes a fuel distribution pipe 3 which distributes and supplies high-pressure fuel to the plurality of fuel injection devices 2 and a fuel pipe 4 which supplies high-pressure fuel compressed by the high-pressure pump to the fuel distribution pipe 3.

The fuel distribution pipe 3 includes a pipe portion 31 and a plurality of cup portions 32.

The pipe portion 31 stores fuel pressure-fed from the high-pressure pump in order to supply the fuel to the plurality of fuel injection devices 2. The pipe portion 31 is formed in a circular pipe shape which linearly extends along a cylinder row direction (a crank shaft direction) of the engine. An inner peripheral surface of the pipe portion 31 forms a fuel passage. In addition, the pipe shape of the pipe portion 31 does not need to be the circular pipe shape extending linearly and may be various shapes.

A lid portion 33 which blocks one end portion of the pipe portion 31 is fixed to one end portion of the pipe portion 31 and a connection portion 34 which is connected to the fuel pipe 4 is fixed to the other end portion of the pipe portion 31. The lid portion 33 and the connection portion 34 may be fixed to the pipe portion 31 by, for example, brazing. One end portion of the pipe portion 31 indicates an end portion opposite to the fuel pipe 4 among both end portions of the pipe portion 31. The other end portion of the pipe portion 31 indicates an end portion on the side of the fuel pipe 4 among both end portions of the pipe portion 31. In addition, a fuel pressure sensor or the like may be connected to one end portion of the pipe portion 31 instead of the lid portion 33.

Figure 2:
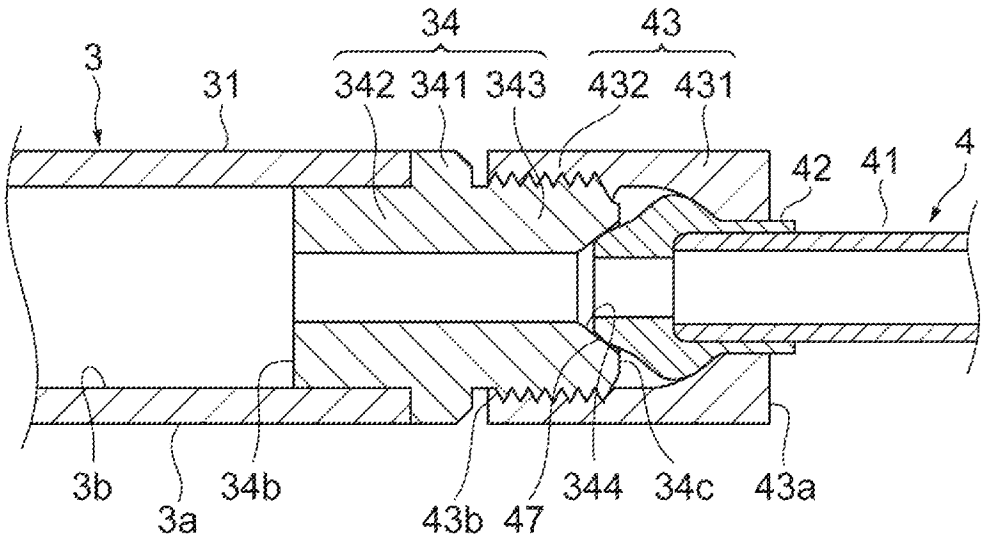
FIG. 2 is a cross-sectional view showing a connection portion between a fuel distribution pipe and a fuel pipe.

FIG. 2 is a cross-sectional view showing a connection portion between the fuel distribution pipe and the fuel pipe. As shown in FIGS. 1 and 2, the connection portion 34 is formed in a circular pipe shape. An inner peripheral surface of the connection portion 34 forms a fuel passage. The connection portion 34 includes a flange portion 341, a fixing portion 342, and a screw portion 343.

The flange portion 341 is located at the center portion of the connection portion 34 in the pipe axis direction and is formed in a flange shape to increase in diameter outward in the radial direction. The fixing portion 342 is located at the side of one end surface 34*b* of the connection portion 34 with respect to the flange portion 341 and is fixed to the pipe portion 31. One end surface 34*b* indicates an end surface opposite to the fuel pipe 4 among both end surfaces of the connection portion 34 in the pipe axis direction. The screw portion 343 is located at the side of the other end surface 34*c* of the connection portion 34 with respect to the flange portion 341 and is connected to the fuel pipe 4. The other end surface 34*c* indicates an end surface at the side of the fuel pipe 4 among both end surfaces of the connection portion 34 in the pipe axis direction. An outer peripheral surface of the screw portion 343 is provided with a male screw to be connected to the fuel pipe 4. An inner peripheral surface of the screw portion 343 is provided with a sealing surface 344 with which the fuel pipe 4 comes into press-contact. The sealing surface 344 is also called a seat surface.

The sealing surface 344 is formed in a tapered shape (funnel shape) that increases in diameter toward the other end surface 34*c* and a cross section passing through the pipe axis of the connection portion 34 has a linear shape. An inclination angle of the sealing surface 344 with respect to the pipe axis of the connection portion 34 can be set to, for example, 60°.

The cup portion 32 is attached to each of the plurality of fuel injection devices 2 and supplies the fuel stored in the pipe portion 31 to each fuel injection device 2. The cup portion 32 is fixed to the pipe portion 31 and holds the fuel injection device 2 so that a gap with respect to the fuel injection device 2 is air-tight. The cup portion 32 can be fixed to the pipe portion 31 by, for example, brazing.

Figure 3:
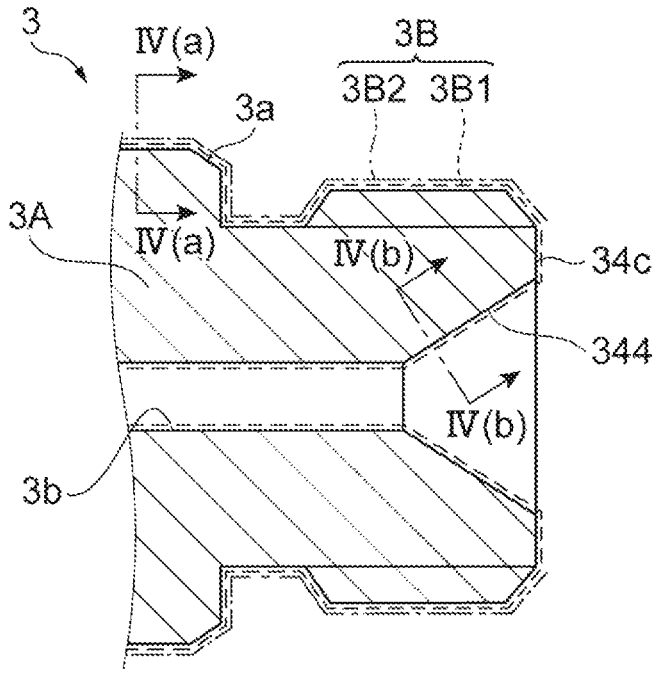
FIG. 3 is a schematic cross-sectional view showing the fuel distribution pipe.

FIG. 3 is a cross-sectional view showing a part of the fuel pipe. As shown in FIGS. 1 to 3, the fuel pipe 4 includes a pipe portion 41, a connection head portion 42, and a connection nut 43.

The pipe portion 41 is provided between the high-pressure pump and the fuel distribution pipe 3 and sends the high-pressure fuel compressed by the high-pressure pump to the fuel distribution pipe 3. An inner peripheral surface of the pipe portion 41 forms a fuel passage.

The connection head portion 42 is connected to the fuel distribution pipe 3. The connection head portion 42 is formed in a circular pipe shape. An inner peripheral surface of the connection head portion 42 forms a fuel passage. The connection head portion 42 is fixed to the pipe portion 41. The connection head portion 42 can be fixed to the pipe portion 41 by, for example, inserting the connection head portion 42 into the pipe portion 41 and brazing the inner peripheral surface of the connection head portion 42 and the outer peripheral surface of the pipe portion 41.

A front end portion of the connection head portion 42 is provided with a press-contact portion 47 which comes into press-contact with the sealing surface 344. An outer peripheral surface of the press-contact portion 47 is formed in a spherical surface shape having a center point on the pipe axis of the connection head portion 42.

The connection nut 43 connects and fixes the connection head portion 42 of the fuel pipe 4 to the connection portion 34 of the fuel distribution pipe 3. The connection nut 43 is formed in a nut shape and a hole into which the connection head portion 42 is inserted is formed at the inside of the connection nut 43 in the radial direction. The connection nut 43 includes a hooking portion 431 and a screw portion 432.

The hooking portion 431 is located at an end portion at the side of one end surface 43*a* of the connection nut 43. One end surface 43*a* of the connection nut 43 indicates an end surface opposite to the fuel distribution pipe 3 among both end surfaces of the connection nut 43. Then, the hooking portion 431 hooks the connection head portion 42 inserted from the other end surface 43*b* of the connection nut 43 into the connection nut 43 from the side of one end surface 43*a*. The other end surface 43*b* of the connection nut 43 indicates an end surface at the side of the fuel distribution pipe 3 among both end surfaces of the connection nut 43.

The screw portion 432 is located at an end portion at the side of the other end surface 43*b* of the connection nut 43. An inner peripheral surface of the screw portion 432 is provided with a female screw to be threaded into the screw portion 343 of the connection portion 34.

Then, when the screw portion 432 of the connection nut 43 is fastened to the screw portion 343 of the connection portion 34, the hooking portion 431 pulls the connection head portion 42 toward the connection portion 34. Accordingly, the press-contact portion 47 of the connection head portion 42 comes into press-contact with the sealing surface 344 and the fuel distribution pipe 3 and the fuel pipe 4 are connected and fixed to each other.

Next, the fuel distribution pipe 3 will be described in more detail with reference to FIGS. 3 and 4.

Figure 4:
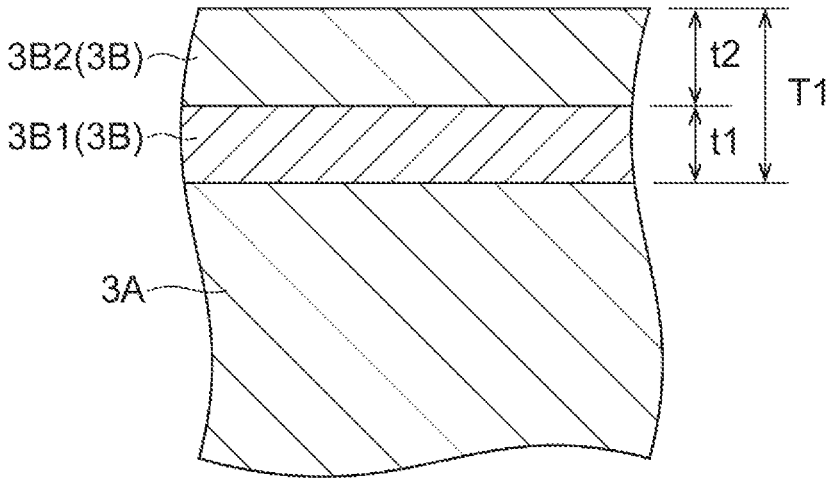
FIG. 4 is a schematic cross-sectional view showing the fuel distribution pipe, where FIG. 4(*a*) is a schematic cross-sectional view taken along a line IV(a)-IV(a) shown in FIG. 3 and FIG. 4(*b*) is a schematic cross-sectional view taken along a line IV(b)-IV(b) shown in FIG. 3.
Figure 4:
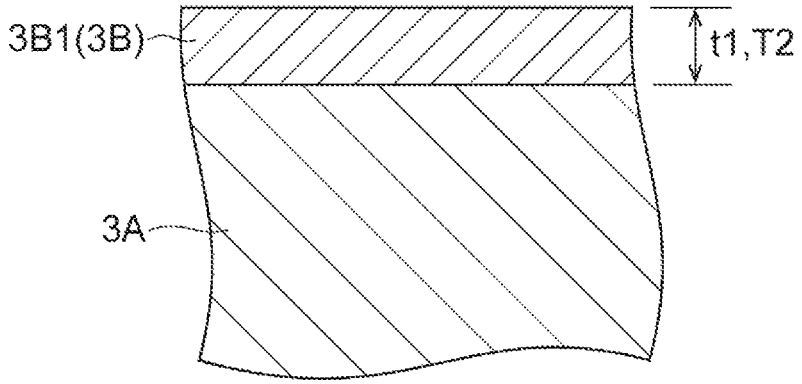

FIG. 4(*a*) is a schematic cross-sectional view taken along a line IV(a)-IV(a) shown in FIG. 3 and FIG. 4(*b*) is a schematic cross-sectional view taken along a line IV(b)-IV(b) shown in FIG. 3. As shown in FIGS. 3 and 4, the fuel distribution pipe 3 includes a base material 3A that is formed in a circular pipe shape to form a body of the fuel distribution pipe 3 and a plating layer 3B which is formed on a surface of the base material 3A.

The base material 3A forms the pipe portion 31, the plurality of cup portions 32, the lid portion 33, and the connection portion 34 described above. The material of the base material 3A is not particularly limited, but can be carbon steel, stainless steel, or the like. Among these materials, carbon steel is preferable from the viewpoint of cost and strength.

The Vickers hardness [Hv] of the sealing surface 344 of the base material 3A is desirably 230 or more and more desirably 250 or more. Further, it is desirable that the Vickers hardness [Hv] of the sealing surface 344 of the base material 3A be equal to or larger than the Vickers hardness [Hv] of the connection head portion 42 of the fuel pipe 4 which is in press-contact with the sealing surface 344. Meanwhile, the Vickers hardness [Hv] of the sealing surface 344 of the base material 3A is desirably 500 or less and more desirably 400 or less from the viewpoint of a sealing property. In addition, when the base material 3A is formed of one material, the Vickers hardness of a surface other than the sealing surface 344 is the same or substantially the same as that of the sealing surface 344.

When a material such as carbon steel having low corrosion resistance is used for the base material 3A, the plating layer 3B coats the entire surface of the base material 3A in order to secure the corrosion resistance of the product. Then, the thickness of the plating layer 3B on the sealing surface 344 is thinner than the thickness of the plating layer 3B on the outer peripheral surface 3*a* of the fuel distribution pipe 3. That is, the sealing surface 344 is provided with the plating layer 3B, but the plating layer 3B on the sealing surface 344 is thinner than that of the outer peripheral surface 3*a*. The outer peripheral surface 3*a* of the fuel distribution pipe 3 corresponds to the outer peripheral surfaces of the pipe portion 31 and the connection portion 34 exposed to the outside and subjected to salt damage from the external environment (see FIG. 2).

Specifically, the plating layer 3B includes a first plating layer 3B1 and a second plating layer 3B2.

The first plating layer 3B1 is a plating mainly used to secure corrosion resistance against fuel such as alcohol fuel and degraded fuel. As the first plating layer 3B1, for example, an electroless nickel plating, an electrical nickel plating, or the like is used. The first plating layer 3B1 is formed on the base material 3A. The thickness t1 of the first plating layer 3B1 is, for example, 3 μm or more and 10 μm or less from the viewpoint of corrosion resistance against the fuel.

The second plating layer 3B2 is a plating which is mainly used to secure corrosion resistance against salt damage from the external environment. As the second plating layer 3B2, for example, a zinc plating, a zinc nickel plating, or the like is used. The second plating layer 3B2 is formed on the first plating layer 3B1. The thickness t2 of the second plating layer 3B2 is, for example, 5 pin or more and 15 μm or less from the viewpoint of corrosion resistance against salt damage from the external environment.

Then, the first plating layer 3B1 is formed on the entire surface of the base material 3A. Meanwhile, the second plating layer 3B2 is formed on the outer peripheral surface 3*a* of the base material 3A, but is not formed on the inner peripheral surface 3*b*, the other end surface 34*c*, and the sealing surface 344 of the base material 3A. The inner peripheral surface 3*b* is a surface which forms a fuel passage.

For this reason, in the outer peripheral surface 3*a*, the plating layer 3B has a two-layer structure in which the first plating layer 3B 1 and the second plating layer 3B2 are stacked in this order. Meanwhile, in the inner peripheral surface 3*b*, the other end surface 34*c*, and the sealing surface 344, the plating layer 3B has a single layer structure only including the first plating layer 3B1. Accordingly, the thickness T2 of the plating layer 3B on the sealing surface 344 is thinner than the thickness T2 of the plating layer 3B on the outer peripheral surface 3*a*. Specifically, the thickness T1 of the plating layer 3B on the outer peripheral surface 3*a* is, for example, 8 μm or more and 25 μm or less. Meanwhile, the thickness T2 of the plating layer 3B on the sealing surface 344 is, for example, 3 μm or more and 10 μm or less.

Here, an example of a method of forming the plating layer 3B will be described with reference to FIG. 5.

Figure 5:
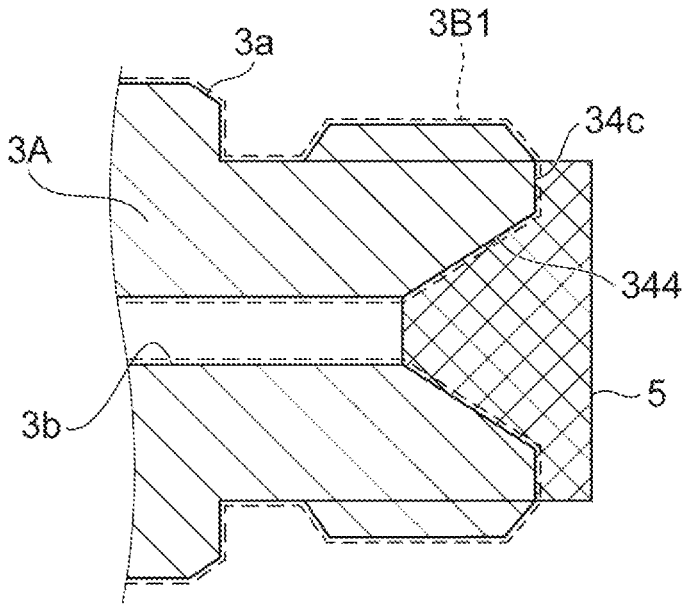
FIG. 5 is a diagram illustrating a plating layer forming method.

FIG. 5 is a diagram illustrating a plating layer forming method. Here, a case will be described in which an electroless nickel plating is formed as the first plating layer 3B1 and a zinc plating or zinc nickel plating is formed as the second plating layer 3B2.

When forming the plating layer 3B on the base material 3A, an electroless nickel plating is first formed on the entire surface of the base material 3A. Accordingly, the first plating layer 3B1 is formed on the entire surface of the base material 3A. The electroless nickel plating can be formed by the known method.

Next, as shown in FIG. 5, the other end surface 34*c* and the sealing surface 344 of the base material 3A provided with the first plating layer 3B1 are covered by the lid 5. The lid 5 may be any member as long as the sealing surface 344 can be covered. Then, a zinc plating or zinc nickel plating is formed on the base material 3A in this state. The zinc plating or zinc nickel plating can be formed by the known method. After the zinc plating or zinc nickel plating is formed, the lid 5 is separated from the base material 3A. Accordingly, the second plating layer 3B2 is formed only on the outer peripheral surface 3*a* without forming the second plating layer 3B2 on the sealing surface 344. In addition, since the other end surface 34*c* is also covered by the lid 5 in the embodiment, the second plating layer 3B2 is not formed on the other end surface 34*c* similarly to the sealing surface 344. However, since the other end surface 34*c* is not a surface which directly contacts the mating component as the sealing surface, the second plating layer 3B2 may be formed similarly to the outer peripheral surface 3*a* while not being covered by the lid 5.

In this way, in the fuel distribution pipe 3 according to the embodiment, since the plating layer 3B is formed on the surface of the base material 3A, corrosion resistance of the fuel distribution pipe 3 can be secured. Further, since the thickness of the plating layer 3B on the sealing surface 344 is thinner than the thickness of the plating layer 3B on the outer peripheral surface 3*a*, it is possible to suppress the cracking of the plating layer 3B due to the reconnection of the fuel pipe 4. Accordingly, it is possible to suppress contamination caused by the plating piece.

Since the number of layers of the plating layer 3B is different in the sealing surface 344 and the outer peripheral surface 3*a*, the thickness of the plating layer 3B on the sealing surface 344 can be easily made thinner than the thickness of the plating layer 3B on the outer peripheral surface 3*a*. Accordingly, since the thickness of the plating layer 3B on the sealing surface 344 is thinner than the thickness of the plating layer 3B on the outer peripheral surface 3*a*, it is possible to suppress contamination caused by the plating piece.

Since the sealing surface 344 is formed in a tapered shape, the adhesion with respect to the connection head portion 42 of the fuel pipe 4 is improved. In this case, a portion inside a position in which the connection head portion 42 is in a press-contact state contacts the fuel even in the sealing surface 344. However, since the plating layer 3B is formed on the sealing surface 344, corrosion resistance at the portion can be secured.

When the base material 3A is carbon steel, cost can be reduced compared to a case in which the base material 3A is stainless steel.

When the first plating layer 3B1 is an electroless nickel plating, it is possible to secure corrosion resistance against fuel such as alcohol fuel and degraded fuel in a portion provided with the first plating layer 3B1. Further, when the second plating layer 3B2 is a zinc plating or zinc alloy plating, it is possible to secure corrosion resistance against salt damage from the external environment in a portion provided with the second plating layer 3B2.

When the Vickers hardness [Hv] of the sealing surface 344 of the base material 3A is 230 or more, deformation of the sealing surface 344 during the fastening is suppressed. Accordingly, the cracking of the plating layer 3B on the sealing surface 344 is suppressed and the number and size of the peeled plating pieces from the sealing surface 344 can be made small.

Since the connection portion 34 and the plurality of cup portions 32 are bonded to the pipe portion 31, the fuel sent from the fuel pipe 4 can be appropriately distributed and supplied to the plurality of fuel injection devices 2.

While preferred embodiments of the invention have been described above, the invention is not limited to the above-described embodiments.

Figure 6:
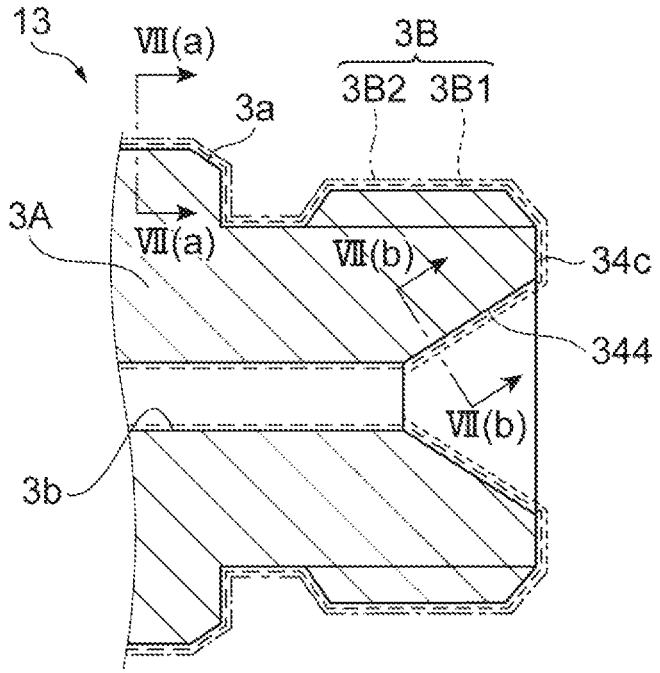
FIG. 6 is a schematic cross-sectional view showing a modified example of the fuel distribution pipe.
Figure 7:
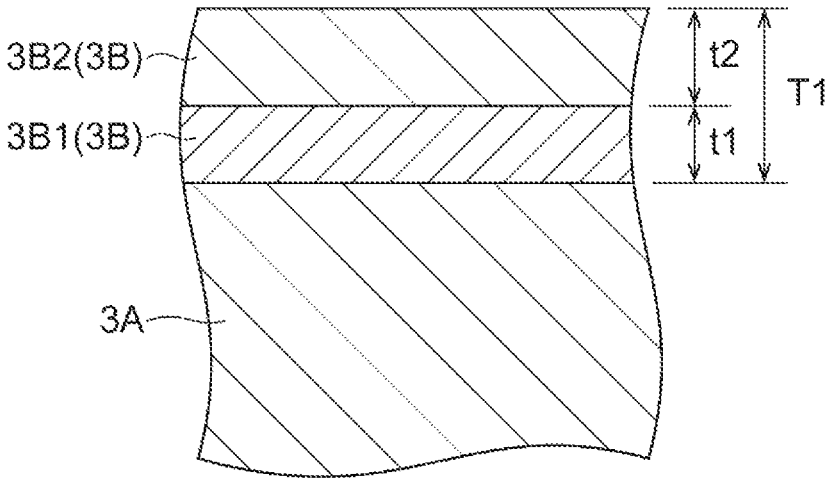
FIG. 7 is a schematic cross-sectional view showing the fuel distribution pipe, where FIG. 7(*a*) is a schematic cross-sectional view taken along a line VII(a)-VII(a) shown in FIG. 6 and FIG. 7(*b*) is a schematic cross-sectional view taken along a line VII(b)-VII(b) shown in FIG. 6.
Figure 7:
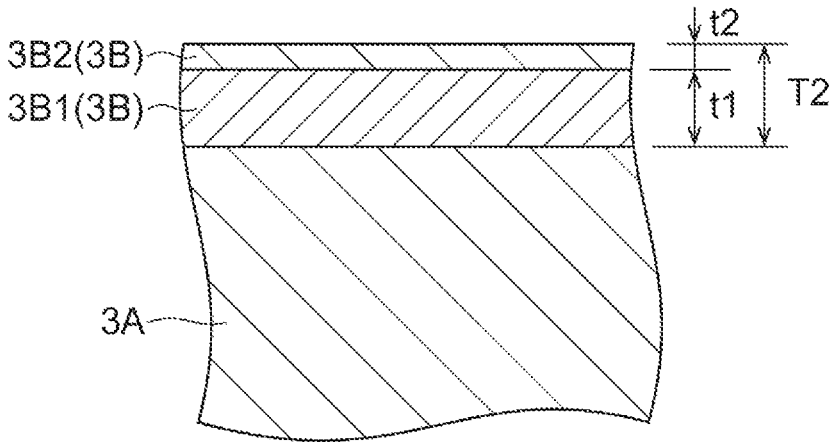

For example, when the plating layer is composed a plurality of layers similarly to the fuel distribution pipe 13 shown in FIGS. 6 and 7, the thickness of the specific layer corresponding to any one layer of the plating layers on the sealing surface may be thinner than the thickness of the specific layer on the outer peripheral surface. In this case, it is desirable that the specific layer be the outermost layer of the plating layer. Further, it is desirable that the thickness of the specific layer on the sealing surface be larger than 0% and equal to or smaller than 80% of the thickness of the specific layer on the outer peripheral surface.

FIG. 6 is a schematic cross-sectional view showing a modified example of the fuel distribution pipe. FIG. 7(*a*) is a schematic cross-sectional view taken along a line VII(a)-VII(a) shown in FIG. 6 and FIG. 7(*b*) is a schematic cross-sectional view taken along a line VII(b)-VII(b) shown in FIG. 6. In the fuel distribution pipe 13 shown in FIGS. 6 and 7, the second plating layer 3B2 is also formed on the other end surface 34*c* and the sealing surface 344 of the base material 3A other than the outer peripheral surface 3*a* of the base material 3A differently from the first embodiment. However, the second plating layer 3B2 on the sealing surface 344 is thinner than the second plating layer 3B2 on the outer peripheral surface 3*a*. That is, the second plating layer 3B2 which is the outermost layer of the plating layer 3B becomes the specific layer. Specifically, the thickness t2 of the second plating layer 3B2 of the outer peripheral surface 3*a* is, for example, 5 μm or more and 15 μm or less similarly to the above-described embodiment. Meanwhile, the thickness t2 of the second plating layer 3B2 on the sealing surface 344 is, for example, 1 μm or more and 12 μm or less.

For this reason, in any one of the outer peripheral surface 3*a* and the sealing surface 344, the plating layer 3B has a two-layer structure in which the first plating layer 3B1 and the second plating layer 3B2 are stacked in this order. However, since the thickness of the second plating layer 3B2 on the sealing surface 344 is thinned, the thickness T2 of the plating layer 3B on the sealing surface 344 is thinner than the thickness T2 of the plating layer 3B on the outer peripheral surface 3*a*. Specifically, the thickness T1 of the plating layer 3B on the outer peripheral surface 3*a* is, for example, 8 μm or more and 25 μm or less. Meanwhile, the thickness T2 of the plating layer 3B on the sealing surface 344 is, for example, 4 μm or more and 22 μm or less.

Here, an example of a method of forming the plating layer 3B shown in FIGS. 6 and 7 will be described with reference to FIG. 8.

Figure 8:
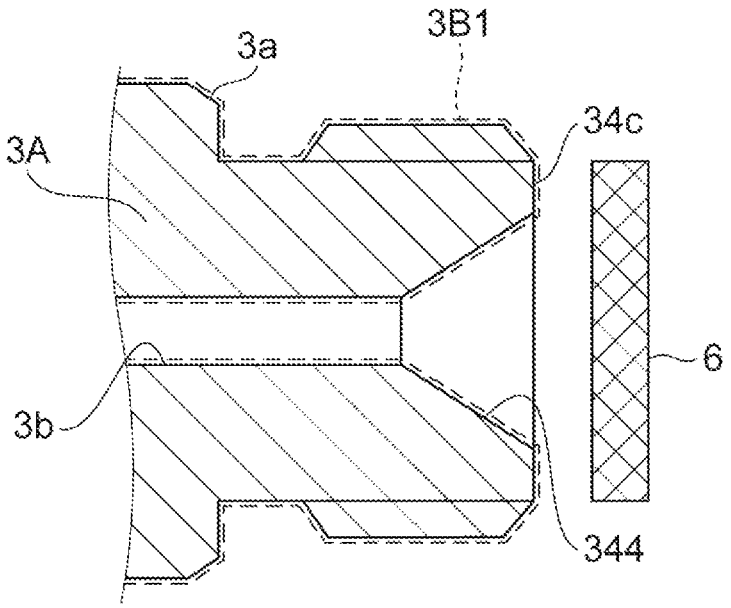
FIG. 8 is a diagram illustrating a plating layer forming method.

FIG. 8 is a diagram illustrating the plating layer forming method. Here, a case will be described in which an electroless nickel plating is formed as the first plating layer 3B1 and a zinc plating or zinc nickel plating is formed as the second plating layer 3B2.

When forming the plating layer 3B on the base material 3A, an electroless nickel plating is first formed on the entire surface of the base material 3A similarly to the above-described embodiment. Accordingly, the first plating layer 3B1 is formed on the entire surface of the base material 3A.

Next, as shown in FIG. 8, a zinc plating or zinc nickel plating is formed on the base material 3A while the auxiliary cathode 6 (the pseudo electrode) is disposed in the vicinity of the sealing surface 344. Then, the second plating layer 3B2 of the zinc plating or zinc nickel plating is formed on the outer peripheral surface 3*a*, the other end surface 34*c*, and the sealing surface 344 of the base material 3A. However, since the zinc plating or zinc nickel plating is formed on the auxiliary cathode 6, the zinc plating or zinc nickel plating is not easily formed on the sealing surface 344. As a result, the second plating layer 3B2 formed on the sealing surface 344 is thinned. Accordingly, the plating layer 3B formed on the sealing surface 344 is thinner than the plating layer 3B formed on the outer peripheral surface 3*a*.

In this way, in the fuel distribution pipe 13, since the thickness of the second plating layer 3B2 is different in the sealing surface 344 and the outer peripheral surface 3*a*, the thickness of the plating layer 3B on the sealing surface 344 can be easily made thinner than the thickness of the plating layer 3B on the outer peripheral surface 3*a*. Accordingly, since the thickness of the plating layer 3B on the sealing surface 344 is thinner than the thickness of the plating layer 3B on the outer peripheral surface 3*a*, it is possible to suppress contamination caused by the plating piece.

In this case, since the thickness of the second plating layer 3B2 on the sealing surface 344 is set to be larger than 0% and equal to or smaller than 80% of the thickness of the second plating layer 3B2 on the outer peripheral surface 3*a*, it is possible to further suppress contamination caused by the plating piece.

Further, in FIGS. 6 and 7, a case has been described in which the second plating layer 3B2 corresponding to the outermost layer is the specific layer, but the specific layer may be, for example, the first plating layer 3B 1 as long as the specific layer is any one of the plating layers.

In the above-described embodiment, a case has been described in which the plating layer 3B is composed two or more layers, but the plating layer 3B may be composed one layer or three or more layers.

EXAMPLES

Next, Examples of the present invention will be described. However, the present invention is not limited to Examples below.

Example 1

First, a pipe portion, a plurality of cup portions, and a connecting portion as a base material were temporarily welded and these were set in a furnace to be brazed. Next, an electroless nickel plating was formed on the entire surface of the base material. Next, a zinc nickel plating was formed on the base material while an auxiliary cathode was disposed in the vicinity of a sealing surface of the connection portion (see FIG. 8). At this time, the zinc nickel plating formed on the sealing surface was adjusted to have a layer thickness of 80% of the zinc nickel plating formed on the outer peripheral surface. Accordingly, a fuel distribution pipe of Example 1 in which the zinc nickel plating formed on the sealing surface was thinner than the zinc nickel plating formed on the outer peripheral surface was obtained (see FIG. 6). Five fuel distribution pipes of Example 1 were prepared.

Example 2

A fuel distribution pipe of Example 2 was obtained by the same method as that of Example 1 except that a zinc nickel plating formed on a sealing surface was adjusted to have a layer thickness of 50% of a zinc nickel plating formed on an outer peripheral surface (see FIG. 6). Five fuel distribution pipes of Example 2 were prepared.

Example 3

A fuel distribution pipe of Example 3 was obtained by the same method as that of Example 1 except that a zinc nickel plating formed on a sealing surface was adjusted to have a layer thickness of 30% of a zinc nickel plating formed on an outer peripheral surface (see FIG. 6). Five fuel distribution pipes of Example 3 were prepared.

Example 4

First, a pipe portion, a plurality of cup portions, and a connecting portion as a base material were temporarily welded and these were set in a furnace to be brazed. Next, an electroless nickel plating was formed on the entire surface of the base material. Next, a sealing surface of the connection portion was covered by a lid, a zinc nickel plating was formed on the base material in this state, and the lid was separated from the base material (see FIG. 5). Accordingly, a fuel distribution pipe of Example 4 in which a zinc nickel plating was formed on an outer peripheral surface and a zinc nickel plating was not formed on the sealing surface was obtained (see FIG. 3). Five fuel distribution pipes of Example 4 were prepared.

Comparative Example

Figure 9:
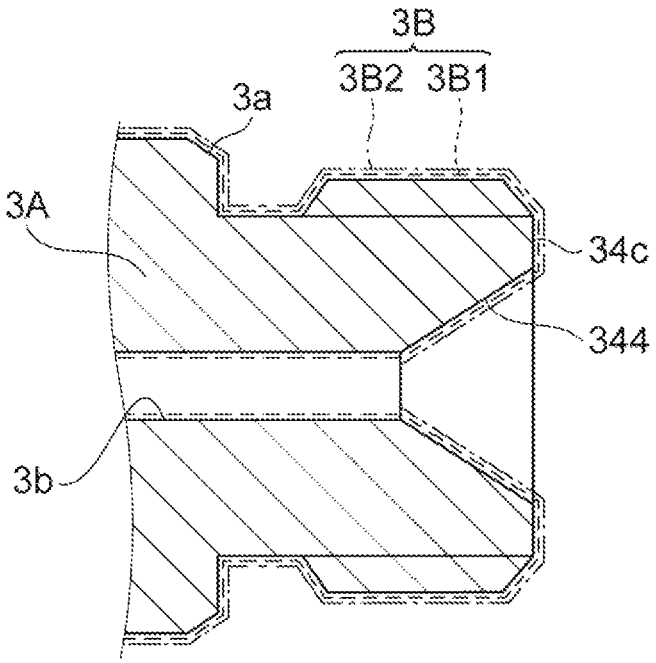
FIG. 9 is a schematic cross-sectional view showing a fuel distribution pipe of a comparative example.

First, a pipe portion, a plurality of cup portions, and a connecting portion as a base material were temporarily welded and these were brazed in a furnace. Next, an electroless nickel plating was formed on the entire surface of the base material. Next, a zinc nickel plating was formed on the entire surface of the base material. Accordingly, a fuel distribution pipe of Comparative Example in which the zinc nickel plating formed on the sealing surface and the zinc nickel plating formed on the outer peripheral surface had the same number of layers was prepared (see FIG. 9). Five fuel distribution pipes of Comparative Example were prepared.

(Evaluation)

For each of the fuel distribution pipes of Examples 1 to 4 and Comparative Example, the number and weight of plating pieces to be peeled off from the sealing surface were measured after one mating component was attached and detached. Specifically, a connection nut was fastened to the fuel distribution pipe and the connection head portion was brought into press-contact with the sealing surface. Next, the connection nut was separated so that the connection head portion was separated from the sealing surface. Then, for the fuel distribution pipes of Examples 1 to 4 and Comparative Example, foreign substances (plating pieces) existing therein were collected and the average number and weight of collected foreign substances were measured. The average number of collected foreign substances is shown in FIG. 10 and the average weight of collected foreign substances is shown in FIG. 11.

Figure 10:
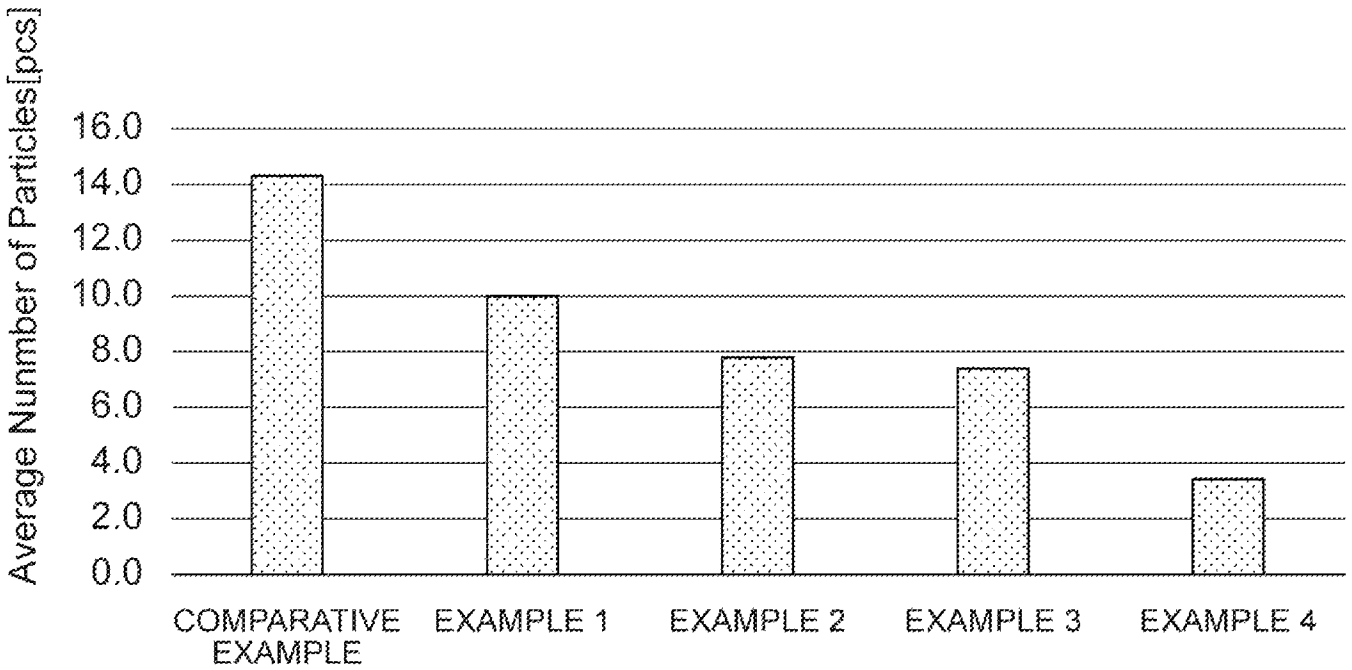
FIG. 10 is a graph showing the average number of collected foreign substances of Examples 1 to 4 and Comparative Example.
Figure 11:
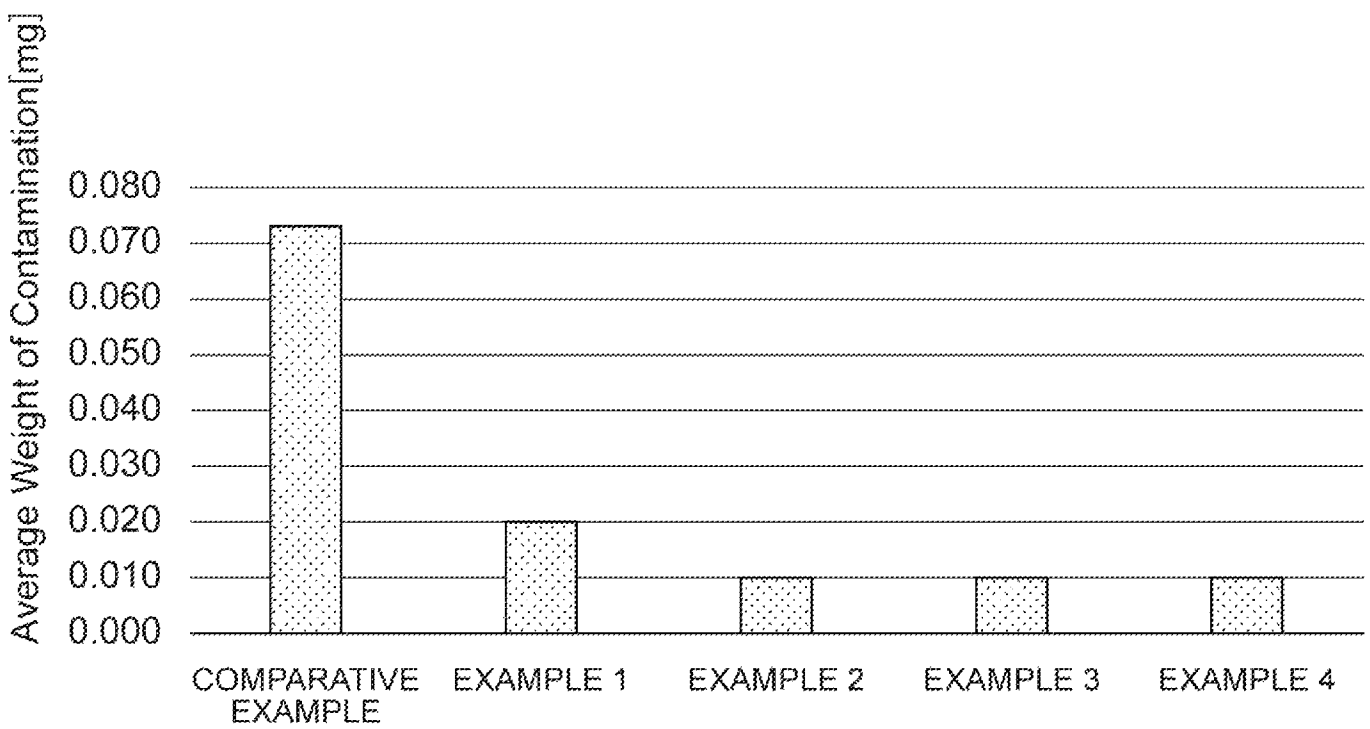
FIG. 11 is a graph showing the average weight of collected foreign substances of Examples 1 to 4 and Comparative Example.

As shown in FIG. 10, in any one of Examples 1 to 4, the average number and average weight of foreign substances were smaller than those of Comparative Example. Specifically, in Example 1, the average number of foreign substances was reduced by 30% and the average weight of foreign substances was reduced by 70% compared to Comparative Example. In Example 2, the average number of foreign substances was reduced by 40% and the average weight of foreign substances was reduced by 90% compared to Comparative Example. From such a result, it was found that contamination of the plating piece can be reduced when the fuel pipe is fastened again when the thickness of the plating layer on the sealing surface 344 is set to be at least 80% or less of the plating layer on the outer peripheral surface 3*a*.

Reference Example 1

Figure 12:
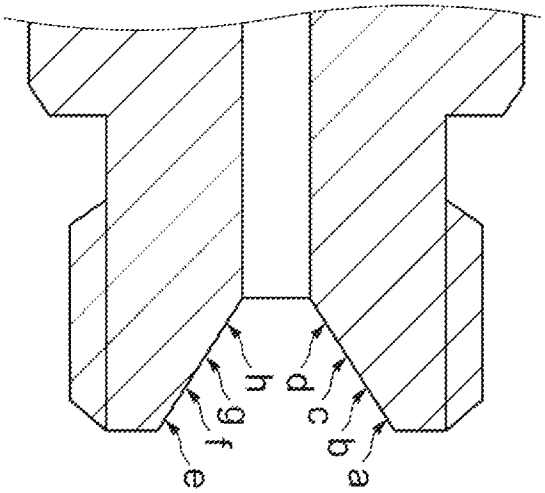
FIG. 12 is a diagram showing a Vickers hardness measurement position.

First, three base materials of a fuel distribution pipe formed of S35C (mechanical construction carbon steel) were prepared. Then, the Vickers hardness of the sealing surface of each base material was measured. The measurement position was set to eight positions a to h shown in FIG. 12. At the time of measuring the Vickers hardness, no plating layer was formed on the base material. The measurement result is shown in Table 1 and FIG. 13.

Next, an electroless nickel plating was formed on the entire surface of each base material. Next, a zinc nickel plating was formed on the entire surface of each base material. Accordingly, three fuel distribution pipes of Reference Example 1 in which the zinc nickel plating formed on the sealing surface and the zinc nickel plating formed on the outer peripheral surface had the same layer thickness were prepared (see FIG. 9).

TABLE 1

| Reference Example 1 (S35C) | | | |
|---|---|---|---|
| Measurement | Vickers hardness [Hv] | | |
| position | Sample 1 | Sample 2 | Sample 3 |
| a | 197 | 172 | 182 |
| b | 173 | 176 | 178 |
| c | 188 | 166 | 170 |
| d | 170 | 163 | 175 |
| e | 167 | 180 | 189 |
| f | 194 | 211 | 185 |
| g | 198 | 197 | 168 |
| h | 198 | 200 | 177 |

Reference Example 2

First, three base materials of a fuel distribution pipe formed of SCM435 (chrome molybdenum steel) were prepared. Then, the Vickers hardness of the sealing surface for each base material was measured. The measurement position was set to eight positions a to h shown in FIG. 12. At the time of measuring the Vickers hardness, no plating layer was formed on the base material. The measurement result is shown in Table 2 and FIG. 13.

Next, an electroless nickel plating was formed on the entire surface of each base material. Next, a zinc nickel plating was formed on the entire surface of each base material. Accordingly, three fuel distribution pipes of Reference Example 2 in which the zinc nickel plating formed on the sealing surface and the zinc nickel plating formed on the outer peripheral surface have the same layer thickness were prepared (see FIG. 9).

TABLE 2

| Reference Example 2 (SCM435) | | | |
|---|---|---|---|
| Measurement position | Vickers hardness [Hv] | | |
| | Sample 1 | Sample 2 | Sample 3 |
| a | 255 | 272 | 245 |
| b | 253 | 261 | 262 |
| c | 262 | 277 | 260 |
| d | 262 | 258 | 244 |
| e | 268 | 280 | 259 |
| f | 261 | 271 | 287 |
| g | 273 | 262 | 246 |
| h | 250 | 249 | 254 |

(Evaluation)

For the fuel distribution pipes of Reference Examples 1 and 2, the number and maximum size of the plating pieces peeled from the sealing surface were measured. Specifically, a connection nut was fastened to the fuel distribution pipe and the connection head portion was brought into press-contact with the sealing surface. Next, the connection nut was separated so that the connection head portion was separated from the sealing surface. Then, for the fuel distribution pipes of Reference Examples 1 and 2, foreign substances (plating pieces) existing therein were collected and the total number and maximum size of collected foreign substances were measured. Table 3 shows the total number of foreign substances collected from the fuel distribution pipe of Reference Example 1 and Table 4 shows the total number of foreign substances collected from the fuel distribution pipe of Reference Example 2. Further, Table 5 shows the maximum size of foreign substances collected from the fuel distribution pipes of Reference Examples 1 and 2.

TABLE 3

| Reference Example 1 (S35C) | |
|---|---|
| Size of foreign substance | Total number of foreign substances |
| 20 to 50 | 59 |
| 50 to 100 | 43 |
| 100 to 150 | 113 |
| 150 to 200 | 207 |
| >200 | 205 |

TABLE 4

| Reference Example 2 (SCM435) | |
|---|---|
| Size of foreign substance | Total number of foreign substances |
| 30 to 60 | 18 |
| 60 to 100 | 9 |
| 100 to 150 | 6 |
| 150 to 300 | 2 |
| >300 | 0 |

TABLE 5

| | Maximum size of foreign substance |
|---|---|
| Reference Example 1 (S35C) | 838 μm |
| Reference Example 2 (SCM435) | 259 μm |

Figure 13:
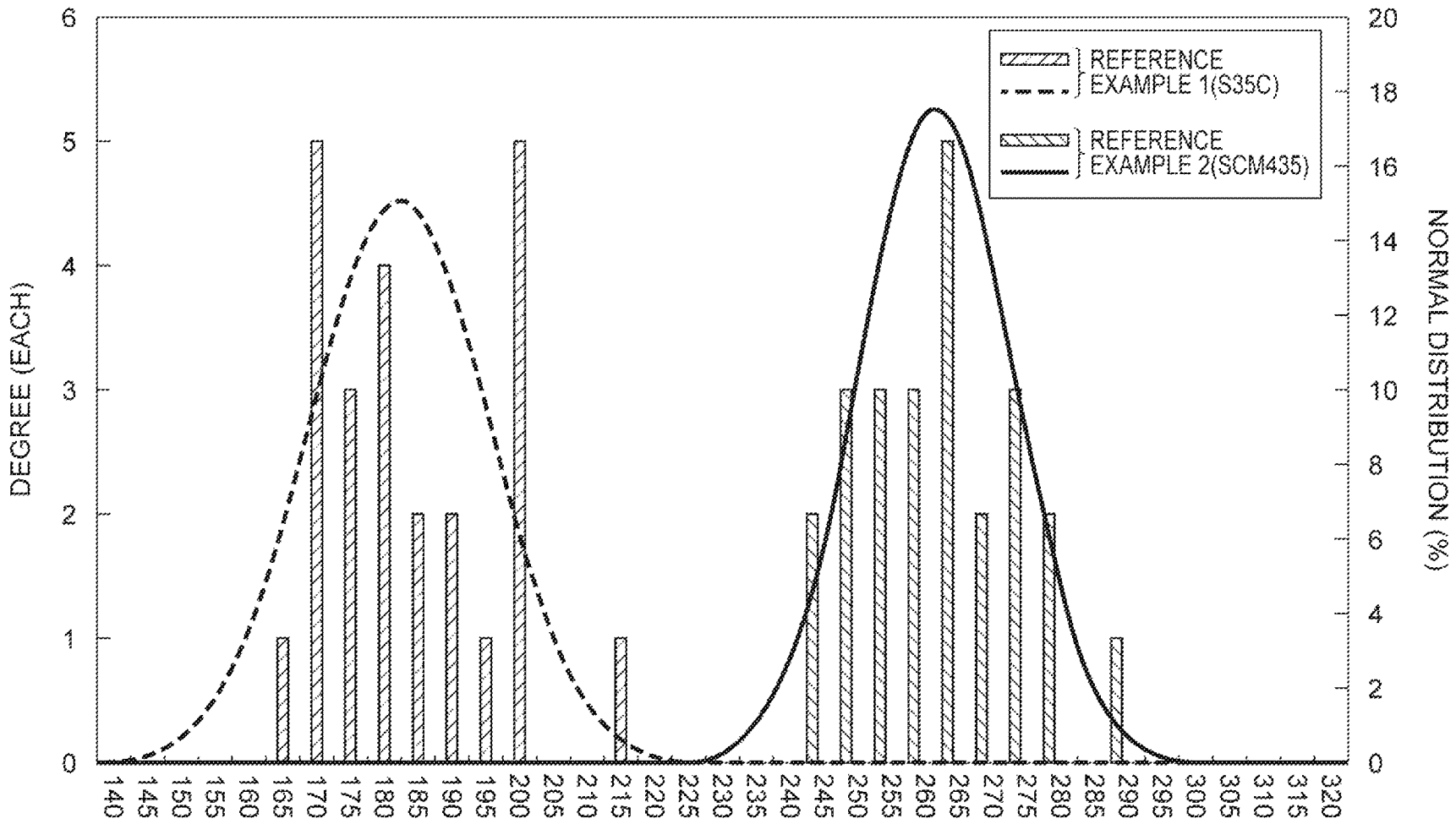
FIG. 13 is a graph showing a Vickers hardness measurement result.

As shown in Tables 1 and 2 and FIG. 13, the Vickers hardness [Hv] of S35C was about 220 or less and the Vickers hardness [Hv] of SCM435 was about 230 or more. Then, as shown in Tables 4 and 5, the total number of foreign substances and the maximum size of foreign substances of Reference Example 2 using SCM435 as a material were smaller than those of Reference Example 1 using S35C as a material. From such a result, it can be presumed that the cracking of the plating layer on the sealing surface is suppressed and the number and size of the plating pieces peeled off from the sealing surface are made small since the Vickers hardness [Hv] of the sealing surface is 230 or more in the above-described embodiments and Examples. This is because deformation of the sealing surface during the fastening is suppressed due to the hardness of the sealing surface equal to or larger than that of the connection head portion when the average Vickers hardness [Hv] of the connection head portion coming into press-contact with the sealing surface is about 230.

REFERENCE SIGNS LIST

1: fuel distribution supply device, 2: fuel injection device, 3: fuel distribution pipe, 3A: base material, 3B: plating layer, 3B1: first plating layer, 3B2: second plating layer, 3*a*: outer peripheral surface, 3*b*: inner peripheral surface, 4: fuel pipe, 5: lid, 6: auxiliary cathode, 13: fuel distribution pipe, 31: pipe portion, 32: cup portion, 33: lid portion, 34: connection portion, 34*b*: one end surface, 34*c*: other end surface, 41: pipe portion, 42: connection head portion, 43: connection nut, 43*a*: one end surface, 43*b*: other end surface, 47: press-contact portion, 341: flange portion, 342: fixing portion, 343: screw portion, 344: sealing surface, 431: hooking portion, 432: screw portion.

The invention claimed is:

1. A fuel distribution pipe connected to a fuel pipe and distributes and supplies fuel to a plurality of fuel injection devices, comprising:

a tubular base material forming a body of the fuel distribution pipe; and a plating layer formed on a surface of the base material, wherein the base material includes a sealing surface formed on an inner peripheral surface thereof and comes into press-contact with the fuel pipe, and wherein a thickness of the plating layer on the sealing surface is thinner than that of the plating layer on an outer peripheral surface of the fuel distribution pipe, and wherein the plating layer is formed from a uniform material along its entire thickness such that the material of the plating layer on the outer peripheral surface is the same material as the plating layer on the sealing surface.

2. The fuel distribution pipe according to claim 1, wherein a thickness of the plating layer on the sealing surface is larger than 0% and equal to or smaller than 80% of the thickness of the plating layer on the outer peripheral surface.

3. The fuel distribution pipe according to claim 1, wherein the sealing surface is formed in a tapered shape increasing in diameter toward an end surface.

4. The fuel distribution pipe according to claim 1, wherein the base material is carbon steel.

5. The fuel distribution pipe according to claim 1, wherein the plating layer is at least one of a nickel plating, a zinc plating, and a zinc alloy plating.

6. The fuel distribution pipe according to claim 1, wherein Vickers hardness [Hv] of the sealing surface of the base material is 230 or more.

7. The fuel distribution pipe according to claim 1, further comprising:

a connection portion provided with the sealing surface and connected to the fuel pipe;

a pipe portion fixed to the fuel distribution pipe; and a plurality of cup portions fixed to the pipe portion and respectively attached to the plurality of fuel injection devices.

8. The fuel distribution pipe according to claim 1, wherein the plating layer has a first plating layer formed on the entire surface of the base material.

9. The fuel distribution pipe according to claim 8, wherein the plating layer has a second plating layer formed on the first plating layer.

10. The fuel distribution pipe according to claim 9, wherein the second plating layer is formed on the outer peripheral surface, but is not formed on the sealing surface.

11. The fuel distribution pipe according to claim 9, wherein the second plating layer is formed on the outer peripheral surface and the sealing surface, wherein a thickness of the second plating layer on the sealing surface is thinner than that of the second plating layer on the outer peripheral surface.

* * * * *